US005637016A

United States Patent [19]

Frech

[11] Patent Number: 5,637,016

[45] Date of Patent: Jun. 10, 1997

[54] HF PLUG CONNECTION SYSTEM

[76] Inventor: Fridolin A. Frech, Im Rain 5, CH-8488 Turbenthal, Switzerland

[21] Appl. No.: 484,705

[22] Filed: Jun. 7, 1995

[30] Foreign Application Priority Data

Oct. 25, 1994 [CH] Switzerland ..... 03193/94

[51] Int. Cl.[6] ..... H01R 9/03

[52] U.S. Cl. ..... 439/610

[58] Field of Search ..... 439/610, 98

[56] References Cited

U.S. PATENT DOCUMENTS

| | | | |
|---|---|---|---|
| 4,361,719 | 11/1982 | Hyde | 439/98 |
| 4,838,812 | 6/1989 | Yoshimura et al. | 439/98 |
| 5,252,081 | 10/1993 | Hart | 439/98 |
| 5,411,415 | 5/1995 | Embo et al. | 439/98 |

FOREIGN PATENT DOCUMENTS

| | | |
|---|---|---|
| 0111162 | 11/1983 | European Pat. Off. . |
| 0525249A1 | 8/1991 | European Pat. Off. . |
| 0608813A2 | 1/1994 | European Pat. Off. . |

*Primary Examiner*—Neil Abrams
*Assistant Examiner*—Barry Matthew L. Standig
*Attorney, Agent, or Firm*—Bachman & LaPointe, P.C.

[57] ABSTRACT

An HF plug connection system with low transfer resistance even in the high frequencies in the range of $10^8$ Hz, comprising a standardised socket insert and a corresponding plug as plug connector parts. In this system, an earthed screening (10) runs from cable to cable (16) through both parts of the plug connector. It is connected over a large area to the metal braid (36) of the HF cable (16) of one and/or the other plug connector part, with large surface area throughout in relation to the cross-section, and at least one flexible area (26, 28) outside the insulation sheath (34), and the screening is passed to large contact areas (46) for the complementary part of the plug connector. Thus the cable end can be adjusted to any required angle, which allows a shorter installation length.

10 Claims, 3 Drawing Sheets

HF PLUG CONNECTION SYSTEM

BACKGROUND OF THE INVENTION

The invention relates to an HF plug connection system with a standardized socket insert and corresponding plug as the plug connector parts, in which system an earthed screening runs from cable to cable through both parts of the plug connector.

Various makes of plug connection system are available on the market, for example with four, six, eight, ten, twelve, fourteen or more poles, as the contacts are known. In these systems, incorrect connections are avoided as the plug connectors have certain geometric shapes and/or external dimensions or are fitted with a coding device.

Plug connection systems are used in particular for electrical connections in main communication and peripheral equipment for example ISDN, telephones, terminals, modems, PCs, host or data network systems.

Conventional HF cables of the known types usually consist of copper wires embedded in a flexible mass, a peripheral shield and an outer insulating sheath. The shield comprises at least a braided, woven or knitted fabric of copper wires, which may on the inside rest on an aluminium foil. Such an HF cable has a defined minimum permitted bending radius which with the usual makes is at least four to five times the external diameter of the cable. If the bending radius is less than this minimum, faults or even failures in operation can be expected.

In the area of HF plug connection systems, the cable screening of a socket insert and associated plug must be electrically connected together or else the earth connection cannot be guaranteed.

In conventional makes, this is generally achieved in one of the following basic methods:

The screening of the two HF cables is connected via a wire of for example 0.5 mm diameter running through the entire plug connection system. At high frequencies (HF) up to approx 1 MHz, the electrical resistance for an earth current is relatively low and negligible because of the low Ohmic value. At higher frequencies, in particular with the frequencies of approx $10^8$ Hz (=100 MHz), normal in modern high tech sectors, the electrical resistance rises to the region of 3–4 kOhm on use of conventional wires, which makes effective earthing impossible.

In another known variant, the screening of the two cables is connected not via a wire but with a conductor of greater cross-section running through the plug system. This design form however has the disadvantage that the cables can only be connected rigidly in one direction or the other. For changes of direction, the HF cable must be bent which can lead to the problems mentioned above. The HF plug connection system with a large bending radius for the HF cable requires a corresponding installation length and hence in addition to the greater space requirements, higher installation costs.

The object of the present invention is therefore to create an HF plug connection system of the type described initially which has a low electrical resistance of a few Ohm even at frequencies in the range of approx $10^8$ Hz, which does not stress the HF cable with bending radii which are too low and which has a shorter installation length.

SUMMARY OF THE INVENTION

The foregoing object is achieved by the invention in that the screening is connected over a large area to the metal braid of the HF cable of one and/or the other plug connector part, this screening having a large surface area throughout in relation to the cross-section, and at least one flexible area outside the insulation sheath, and the screening is passed to large contact areas for the complementary part of the plug connector, where the cable end can be adjusted to any required angle.

Like all HF plug connection systems, the present comprises formative and supportive plastic parts which also serve as electrical insulation and are known to the expert, so will not be described in more detail here. The HF plug connection system also usually comprises a conductor plate and contact elements with the corresponding wiring.

The two parts of the plug connector of the HF plug connection system according to the invention are a socket insert and a corresponding plug. With regard to the shorter design form, in particular the design of the socket insert which is firmly mounted is preferred. The short installation length of a plug is in practice of less importance but may be useful in special cases.

An HF cable is connected over a large area if its shield is surrounded completely and electrically conductively by a screening preferably over a length at least equal to the radius of the cable. As part of the present invention, the surface area of the screening is described as large in relation to the cross-section if its surface area in relation to the same length is at least 50% of the surface area of the shield in the HF cable. In other words, the screening is connected electrically conductively over at least 50% of the circumference of the shield. To avoid confusion between the shield in the HF cable and the screening in the HF plug connection system, this shield will hereinafter be referred to as braid even if it is a woven or knitted fabric and/or aluminium foil. The term screening will be used exclusively for the connection area of two cables in an HF plug connection system.

The screening preferably consists of a plate made from material with good properties of electrical conduction, which is foldable and/or bendable at least in zones, and in particular is made of one piece. Easily machinable metal plates, for example of brass, copper, aluminium or iron, are particularly suitable. These metal plates may be suitably coated to increase the electrical conductivity, e.g. by tin, silver or gold plating.

As the transfer resistance plays a decisive role in HF plug connection systems, in particular at very high frequencies, even complex structure screening is preferably made from one piece in all cases. If the screening consists of several parts and/or comprises further parts such as an integrated housing cover, the connection must be designed with good electrical conductivity, for example by plugs, terminals, soldering or similar.

In a particularly advantageous design form of the invention, the screening consists of a rigidly formed shield connection on the cable, an equally rigidly formed screening housing, open at the side, and a plate of metal with good electrical conductivity flexibly connecting the two rigid components. This screening may also be punched from a plate in one piece and for example folded with a suitable folding device.

In the flexible plate between the shield connection and the screening housing, are formed preferably two parallel specified bending areas where the cross-section of the plate is reduced at the point concerned. It must be ensured that the plate is bent as roundly as possible rather than folded, which can be achieved with round punching lines.

The flexible plate between a rigid shield connection and a rigid screening housing can be achieved with all means functionally equivalent to the said bending plate and which leads to the same result with or without specified bending points, for example with a three dimensional flexible metal bellows.

The said complete openings over a large area in the screening housing are connected electrically conductively with a metal housing cover which is part of the screening. The screening housing and housing cover thus form a protective metal cage for all exposed lines and their connection elements.

The closed housing cover preferably fulfills a further function as it retains the flexible plate with the shield connection, such that on folding the shield connection, a different area is bent than when the housing lid is open.

With the HF plug connection system according to the invention, cumulatively the following advantages can be achieved:

- The transfer resistance can be kept in the range of a few Ohm even at frequencies in the range of approx $10^8$ Hz.
- Thanks to the complete large area flexible screening at least in the area outside the cable sheath, i.e. in the area of the exposed wires, the cable can be adapted by bending to any angle without the risk of kinking or having too tight a bending radius.
- A side cable connection in relation to the plug direction at any angle can shorten the installation length of the HF plug system.
- With the housing cover closed, the flexible plate in the screening can be bent at a second bending zone as the angle of the cable end changes. After removing the housing cover and bending the shield connection back at an exposed first bending zone, the installation area for the cable is fully exposed.
- The simple design allows the advantages with no loss of economy.

BRIEF DESCRIPTION OF THE DRAWINGS

The invention is now described in more detail using design examples which are the subject of dependent patent claims. The drawings show:

DETAILED DESCRIPTION

Figure 1:
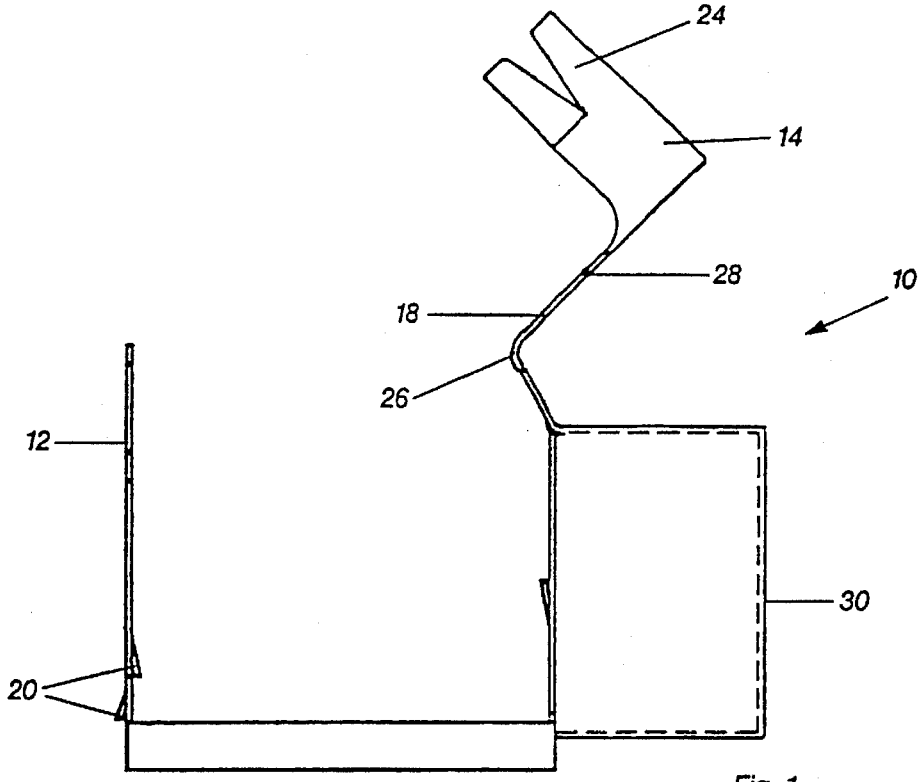
FIG. 1 a side view of the metal screening of a socket insert in an HF plug connection system, FIG. 2 a cross-section of the fitted socket insert, without plastic housing, in the area of line II—II of FIG. 3, FIG. 3 a view of the metal screening with the shield connection bent back, FIG. 4 a section through a housing cover along line IV—IV of FIG. 5, FIG. 5 a back view of the housing cover, FIG. 6 a top view of a covered socket insert with connected cable, and FIG. 7 a locking device for the housing lid with the screening housing.

FIG. 1 shows the metal screening 10 of a socket insert for a HF plug connection system where the said screening essentially comprises a screening housing 12 open on both sides in the direction of view, a shield connection 14 for a cable 16 (FIG. 2) and a flexible plate 18. Screening housing 12, shield connection 14 and flexible plate 18 are formed from one piece by multiple folding, in the present case from an iron plate with a tin coating approximately 0.3 mm thick applied electrolytically, which guarantees good electric conductivity and also protects against corrosion.

Figure 4:
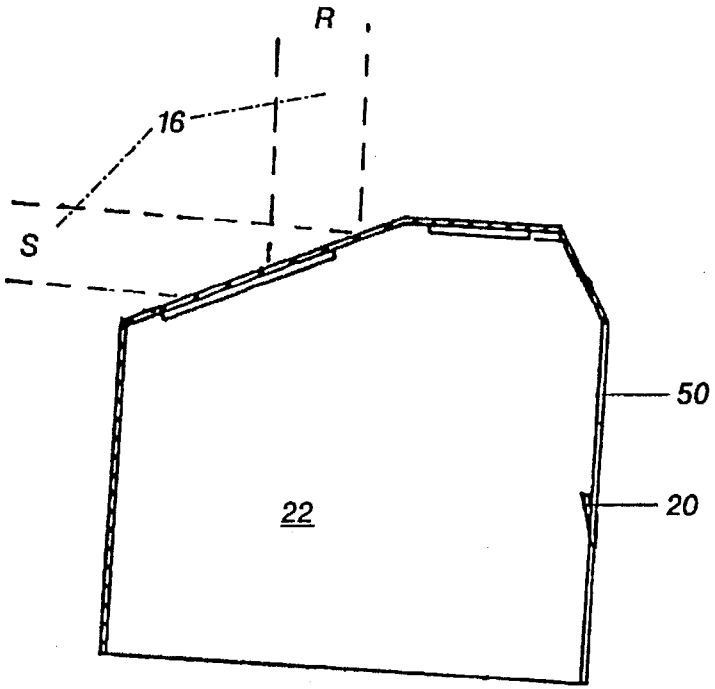

The screening housing 12 has several locking tabs 20 which serve to interlock with a housing cover 22 (FIG. 4). The housing cover, interlocked several times with the screening housing 12, with the shield connection 14 closed in accordance with FIG. 4, forms a closed metal cage which is stable in form despite the many folds.

The shield connection 14 is essentially U-shaped with two folding crimp tabs 24 which serve to fix a cable, not shown in FIG. 1. The shield connection 14 with the folded crimp tabs 24 forms a rigid clamping of the cable.

The flexible plate 18 is bent along a first specified bending area 26. A second specified bending area 28 remains temporarily unchanged and straight. The material, geometric shape and bending process are adapted such that no bending edges, which increase transfer resistance, are created, but rather bending radii.

An essential part of the screening housing 12 is a connected housing 30 in the contact area of the socket insert and plug. When a cable is inserted, no installation work is necessary in the housing as this area is prewired by the supplier. However as FIG. 1 clearly shows, with the shield connection 14 bent back the interior of the screening housing 12 is fully exposed for installation work on three sides.

Figure 2:
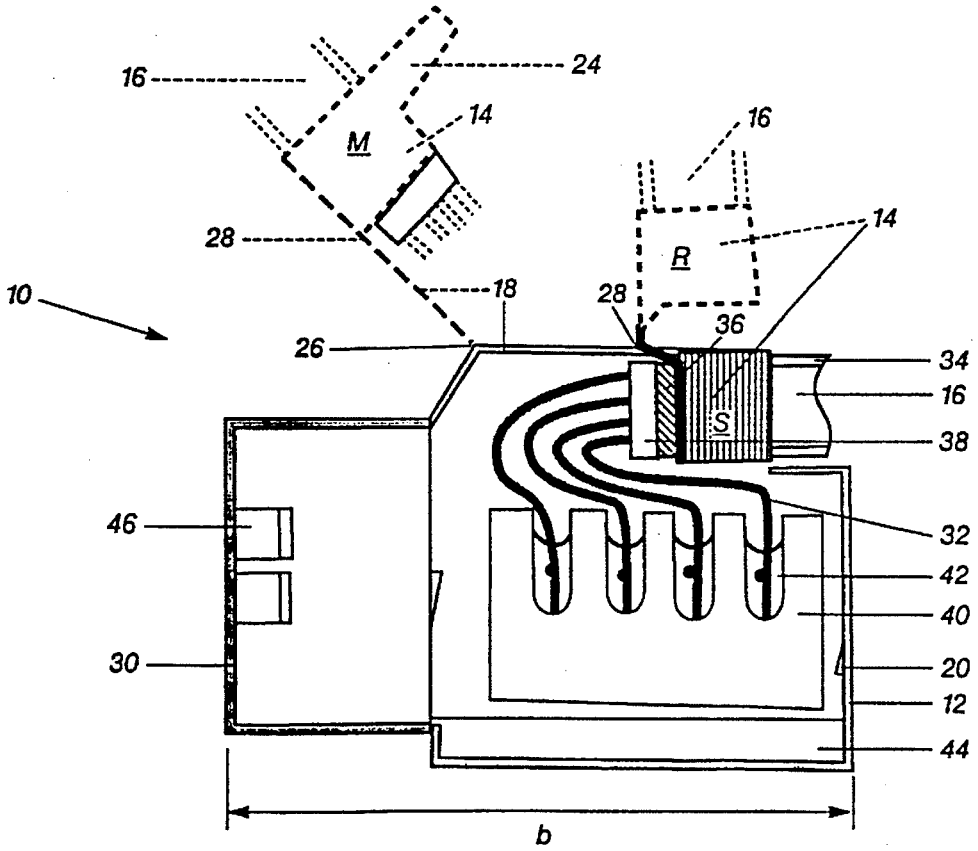

FIG. 2 shows a fitted socket insert with a screening 10 essentially corresponding to FIG. 1. For the sake of simplicity and clarity, the supportive plastic parts of the socket insert have been omitted as these are of the usual type known to the expert.

In position M, the shield connection 14 is bent back and thus the interior of screening housing 12 fully exposed. A cable 16 is shown laid in the shield connection 14 and already attached with a crimp tab 24. As in FIG. 1, the flexible plate 18 is bent only along a first specified bending area 26 while a second specified bending area 28 remains unchanged.

In position R of shield connection 14, the first specified bending area 26 of the flexible plate 18 is bent such that it is integrated into the contour of the screening housing 12. The screening housing 12 is now ready for installation of the housing cover 22 (FIG. 4), which retains the flexible plate 18. In the second specified bending area 28, the flexible plate 18 is bent at approximately right angles, the cable 16 runs at an angle to the plug direction.

The second specified bending area 28 may remain extended, so that the shield connection 14 lies in the position S as shown.

Depending on requirements, the bending angle for the second specified bending area 28 may vary within broad limits, in particular from a cable 16 running at approximately right angles to the direction of plug (position R) to approximately 180° with the cable connection to the back (position S). Depending on design of the housing cover, when this is closed and locked, the shield connection 14 on cable 16 may also be bent beyond the right angle from position R and/or the extended position S may be exceeded. It is never necessary to bend cable 16 itself significantly, the exposed wires 32 easily adapt to any angle change in the specified bending areas 26, 28.

Figure 6:
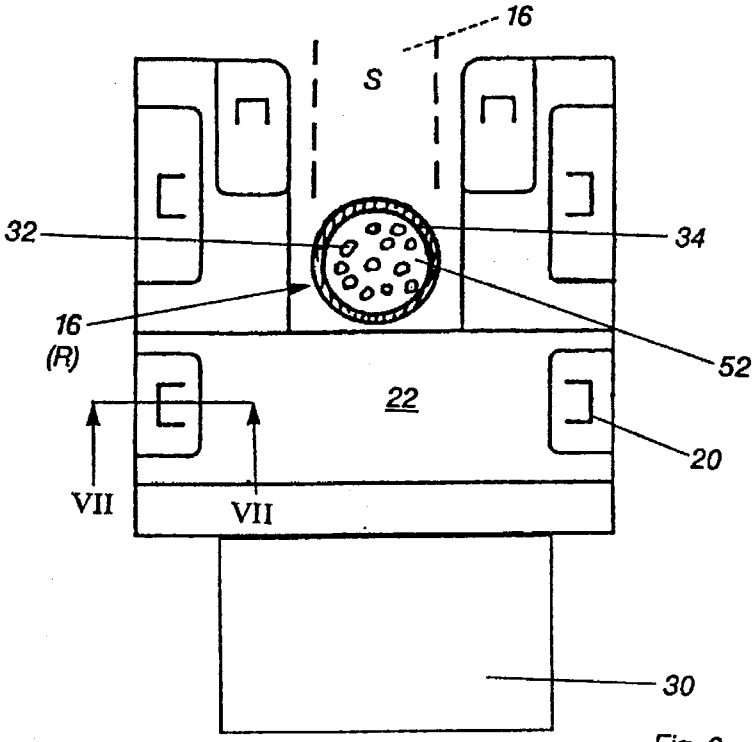

In the present example, cable 16 comprises four wires 32 embedded in a flexible mass 52 (FIG. 6). Outside the shield connection 14, cable 16 is protected with an insulating sheath 34. In the area of the shield connection 14, the insulating sheath 34 is completely removed and the metal braid exposed over the entire periphery, and after displacement is firmly clamped to make good contact. When the metal braid 36 is displaced, the aluminium foil 38 underneath, and which surrounds the embedding mass for the wires 32, is exposed. This foil completes the metal screening and also serves as a moisture barrier in the cable 16.

Inside the screening housing 12 is mounted a connection element 40. For each of the four wires, this has a cutting terminal connection 42 in which the insulation of the introduced wire 32 is cut and the metal contact is created, in the simplest manner, by pressing. Cutting terminal connections of this type are available commercially and are described for example in more detail in EP, A1 0088162.

Below the connection element 40 is mounted a conductor plate 44 extending into the housing 30, from which electrically conductive wires, not shown for the sake of simplicity, run to contact elements from which the electrical current is transferred in the known manner to the slide contacts of a plug.

In the area of the housing 30 are shown two further contact elements 46 which electrically conductively connect the screening of the socket insert with that of the plug when the plug is inserted.

As summarized again below, FIG. 2 shows that:

cable 16 can run straight and unchanged in all positions of the shield connection 14; only the exposed wires 32, which naturally can also be strands, are bent. Thus the cable 16 or its shield 36, 38 is protected and no harmful effects in this respect are created.

for installation work, the shield connection 14 can be bent completely outside the area of activity, which allows simple economic installation.

the angle of the screening housing 12 when the flexible plate 18 is retained by the housing cover can be adapted in any way with regard to the second specified bending area 28, which not only allows shorter installation lengths for HF plug connection systems, in particular socket inserts, but also allows any required cable laying in the optimum position.

the inner area of screening housing 12 and thus the entire connection area of the cable 16 in positions R and S, including all other positions with adjustable angle in the second specified bending area 28, after attachment of the housing cover 22, lies in an enclosed cage and in this respect is not subject to any interference.

Figure 3:
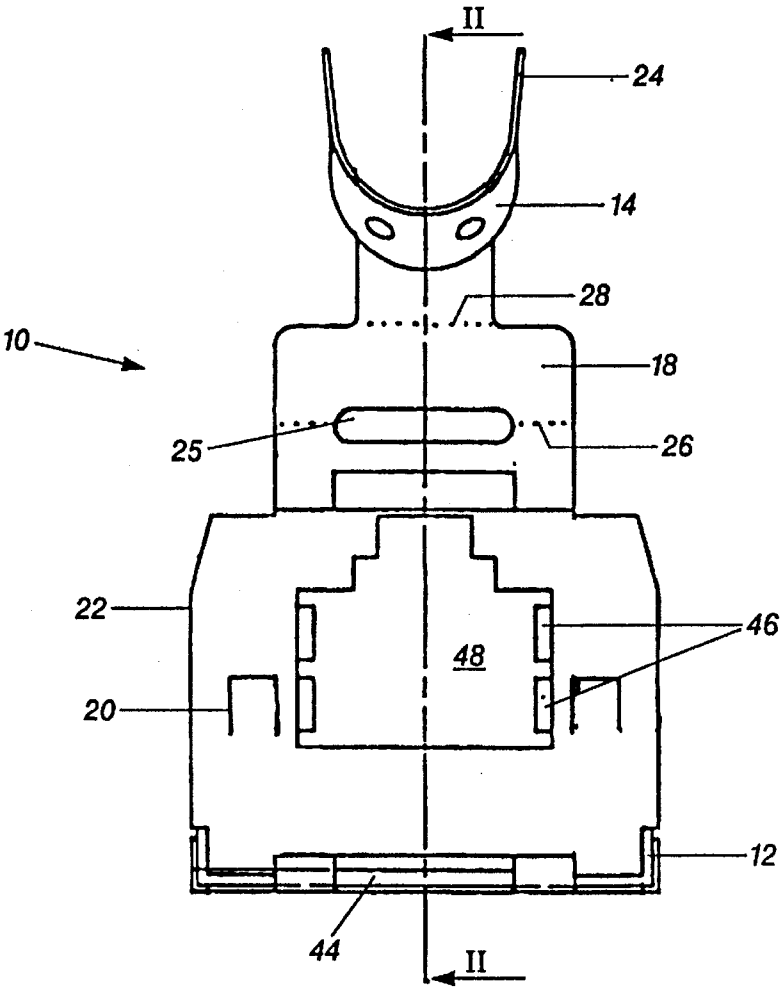

The metal screening 10 shown from the front in FIG. 3 with a screening housing 12 has an insertion opening 48, also called a mouth, for a plug.

The flexible plate 18 with shield connection 14 is bent forwards in the first specified bending area 26. The reduction in cross section is achieved with a slotted cut-out 25. In the second specified bending area 28, the plate is straight.

Figure 5:
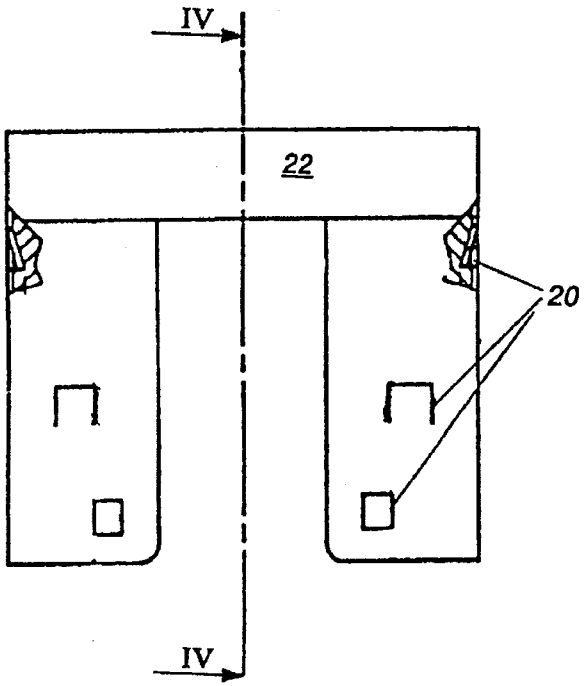

The housing cover 22 shown in FIGS. 4 and 5 is applied over a screening housing 12 and locked such that the housing 30 extends through a slotted opening 50 to protect the contact area of the socket insert and plug (FIG. 1,2). When the housing cover 22 is applied, it is interlocked via locking tabs 20 with the screening housing 12 to be electrically conductive.

Cable 16 of the covered plug connector part is shown in FIG. 6 in cross-section above housing cover 22. The metal braid 36 arranged inside the insulating sheath 34, and the aluminium foil 38 (FIG. 2), are not visible. In the present case, cable 16 contains twelve wires 32 which are embedded in a flexible mass 52. The position of cable 16 is indicated with R in accordance with FIGS. 2 and 4, the cable is bent through approx 90° in relation to the plug direction in the second specified bending area 28 (FIG. 2). Position S, with screening not bent in the second specified bending area 28 (FIG. 2), is shown in dotted lines.

Figure 7:
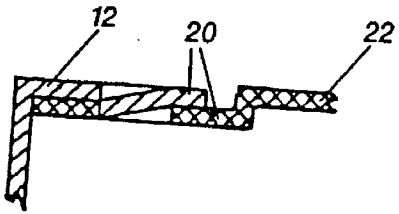

FIG. 7 shows in detail the interlocking of the screening housing 12 and housing cover 22 by means of two locking tabs 20. According to the design form in FIG. 6, the housing cover 22 and thus the screening housing 12, have six such locking tabs 20, which considerably increases the mechanical stability of the folded screening housing.

I claim:

1. In an HF plug connection system having an earth screening and a standardized socket insert and corresponding plug connector, the improvement comprising:

an HF cable having an insulating sheath portion and a metal braid portion; and an earth screening having a portion connected over a large area to the metal braid portion of the HF cable, said screening having a large surface area in relation to cross-section wherein the portion of the screening connected to the metal braid is flexible so as to allow the cable to be adjusted to any required angle relative to a complementary plug connector with minimum bending of the cable.

2. A system according to claim 1 wherein the portion of the screening connected to the metal braid has a bendable plate integral with the screening and formed of material with good electrical conductivity.

3. A system according to claim 2 wherein the screening is made of one piece and comprises a rigidly formed shield connection connected to the cable, a rigidly formed screening housing having an opening at the side, and a flexible plate of material with good electrical conductivity between the two rigidly formed components.

4. A system according to claim 3 wherein the flexible plate (18) is formed with two specified bending areas.

5. A system according to claim 1 wherein the screening comprises a rigidly formed shield connection connected to the cable, a rigidly formed screening housing having an opening at the side, and a bellows of metal of good electrical conductivity flexibly connecting the two rigidly formed components.

6. A system according to claim 5 wherein the shielding connection consists of crimp tabs.

7. A system according to claim 5 wherein the opening to the screening housing (12) has contact springs arranged in the opening for receiving a plug.

8. A system according to claim 5 wherein the flexible plate with shield connection (14) for the cable has a first specified bending area and a second specified bending area.

9. A system according to claim 8 wherein a housing cover is interlocked with the screening housing via locking tabs.

10. A system according to claim 1 wherein the screening is electrolytically plated with metal.

* * * * *